United States Patent [19]

Bräuer et al.

[11] Patent Number: 4,465,438

[45] Date of Patent: Aug. 14, 1984

[54] PISTON DIAPHRAGM PUMP

[75] Inventors: Rüdiger Bräuer, Hamburg; Dirk Petersen, Travenbruck, both of Fed. Rep. of Germany

[73] Assignee: Bran & Lübbe GmbH, Norderstedt, Fed. Rep. of Germany

[21] Appl. No.: 377,573

[22] Filed: May 12, 1982

[30] Foreign Application Priority Data

Feb. 5, 1982 [EP] European Pat. Off. ..... 821000833.1

[51] Int. Cl.[3] ..... F04B 9/08; F04B 43/06

[52] U.S. Cl. ..... 417/386; 417/395

[58] Field of Search ..... 417/383, 385–387, 417/395

[56] References Cited

FOREIGN PATENT DOCUMENTS 2843054 4/1980 Fed. Rep. of Germany ..... 417/383

295905 2/1971 U.S.S.R. ..... 417/385

*Primary Examiner*—Leonard E. Smith

*Assistant Examiner*—Jane E. Obee

*Attorney, Agent, or Firm*—Browdy and Neimark

[57] ABSTRACT

A piston diaphragm pump includes a support plate, disposed on the side of the piston work chamber, for the diaphragm, which is held in a freely movable manner counter to the pressure of a plurality of springs engaging its circumference. A control push rod under the pressure of another spring, counter to the support plate, engage the circumferential area of the support plate and has a conical recess on its circumference, along which slides a displaceable locking member for a refill valve for the hydraulic fluid during the movement of the control push rod. The refill valve opens only when the support plate displaces the control push rod counter to the pressure of its spring as a consequence of a lack of hydraulic fluid in the pump.

5 Claims, 1 Drawing Figure

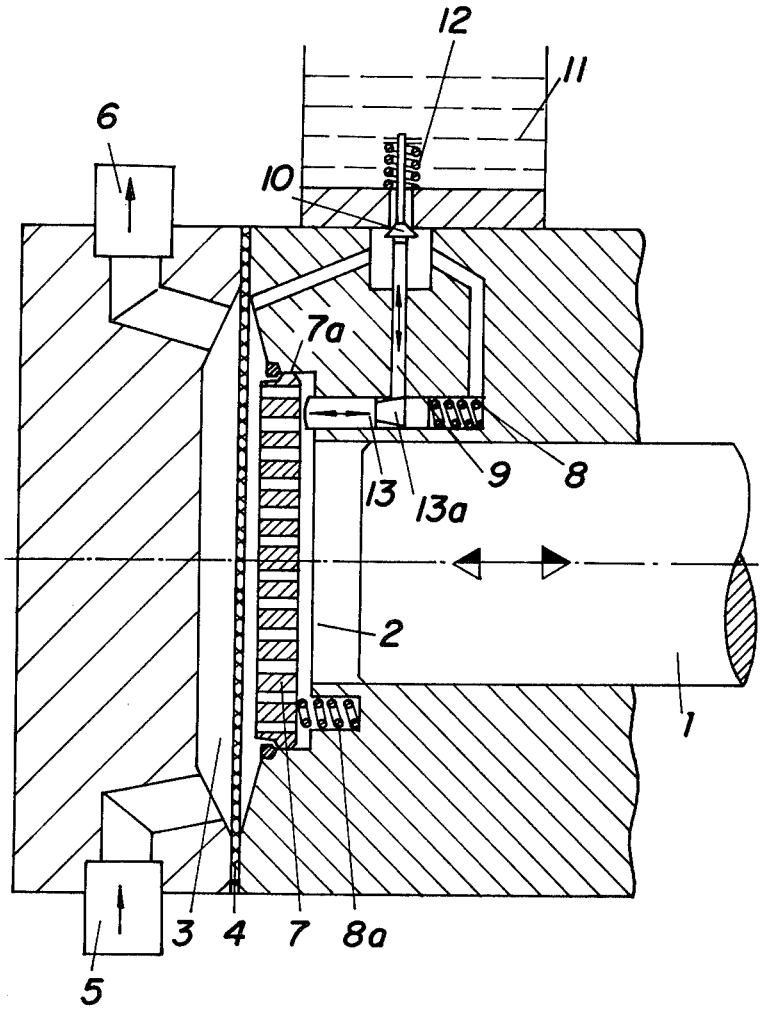
12
11
6
10
7a
9
8
13
13a
2
1
3
4
7
8a
5

PISTON DIAPHRAGM PUMP

FIELD OF THE INVENTION

The invention relates to a piston diaphragm pump, also called a diaphragm plunger pump, having a diaphragm separating the supply chamber from the piston work or drive chamber. The diaphragm is actuated via the hydraulic medium completely filling the piston work chamber by means of a reciprocating piston oscillating within this chamber. The pump also has a reservoir for the hydraulic medium, which communicates with the drive chamber via a refill valve, and further includes a moveable support plate for the diaphragm which is spring actuated. A refill valve is provided which allows the hydraulic medium to pass from the reservoir to the piston work chamber.

BACKGROUND OF THE INVENTION

The piston diaphragm pump known from German Pat. No. 2 843 054 has proved to be extremely advantageous. When there is an underpressure in the piston work chamber, the refill valve cannot open until the diaphragm, which is deflected toward the piston work chamber during the suction stroke, displaces the support plate counter to the spring force and thus allows the refill valve to open.

In this design, however, a central protrusion is firmly connected to the support plate, which results in a number of serious disadvantages. The apparatus is vulnerable to canting and soiling, which may be caused by material wearing off from a gasket. As the finished size of the pump increases, there is also an increase in the masses which must be accelerated, further impairing pump operation. The waste space is relatively large and makes ventilation difficult. Finally, because of the large cross section of the protrusion, increased friction losses occur, so that the internal pressure losses are correspondingly high as well.

SUMMARY OF AN INVENTION

In consideration of this prior art, it is the object of the invention to embody the piston diaphragm pump of the above-described general type such that these disadvantages are avoided and there is a minimum of mass to be accelerated even with an increased pump size, while at the same time the internal pressure losses are lowered.

This object is attained in accordance with the invention in that the valve can be held in the closed state in its normal blocking position by means of a control push rod under the force of a spring and directed counter to the support plate, which is freely displaceable and tiltable; on the other hand, the refill valve can be released for opening after a displacement of the control push rod counter to the force of the spring by means of the support plate. The support plate is now freely movable and is capable of sliding or tilting counter to the pressure acting upon the control push rod, thus initiating refilling.

In a preferred embodiment of the invention, an operating rod is provided between the control push rod and the valve in order to arrest and release the refill valve. The control push rod preferably has a conical recess on its circumference, along which the operating rod slides as the control push rod is displaced. Upon actuation, the control push rod preferably rests on the support plate at its periphery.

Several springs are preferably provided, engaging the circumference of the support plate.

Further advantages, details and characteristics essential to the invention will be understood from the following description of a preferred embodiment of the invention, referring to the drawing.

BRIEF DESCRIPTION OF THE DRAWING

The single FIGURE of the drawing is a section taken through a piston diaphragm pump according to the invention, illustrated schematically.

DESCRIPTION OF THE PREFERRED EMBODIMENT

The illustrated piston diaphragm pump has a positive-displacement piston 1, which reciprocates in an oscillating fashion within a piston work or drive chamber 2 which is completely filled with hydraulic medium. The diaphragm 4 disposed between the supply chamber 3 and the piston work chamber 2 accordingly executes a diaphragm stroke which corresponds to the volume of the piston stroke.

During the suction stroke, the fluid to be supplied flows via the suction valve 5 into the supply chamber 3, and the fluid is expelled during the compression stroke.

A support plate 7 is located in the piston work chamber 2; although it is freely movable, it has a safety means preventing it from falling out toward the diaphragm 4. Plate 7 is formed with an outer edge annular bead **7*a* having a rounded outer surface which facilitates tilting motion of plate 7**.

In the illustrated embodiment, several springs **8*a* engage the circumference of the support plate 7. These springs 8*a* are capable of exerting a pressure on the support plate 7 which acts in the direction toward the diaphragm 4**.

A control push rod 13 also engages the periphery of the support plate 7 and is provided with a conical recess **13*a*. The control push rod 13 is under the pressure of a spring 8 with its effective direction being toward the support plate 7**.

An operating rod 9 engages the vicinity of the conical recess **13*a* of the control push rod 13, substantially perpendicular thereto, and with its other end the operating rod 9 is connected with the closing body 10 of the valve 12. The length of the operating rod 9 is selected such that when it rests on the outer area of the circumferential recess 13*a* of the control push rod 13, the valve is kept in its closed position, so that hydraulic medium is incapable of flowing out of the supply container 11** into the piston work chamber. This position is the normal position for the apparatus.

When the unavoidable losses in hydraulic medium after a certain amount of time in operation cause the diaphragm position gradually to shift toward the piston work chamber during the intake stroke, the diaphragm 4 reaches the support plate 7 and displaces it, counter to the pressure of the springs **8*a*, in the direction of the piston work chamber, against the spring-loaded control push rod 13. The control push rod 13, which now rests on the support plate 7, necessarily moves in the same direction, counter to the spring force 8, so that the operating rod 9 slides down along the conical circumferential recess 13*a* of the control push rod 13. At other times, the push rod may or may not touch the freely displaceable support plate 7. As a result, the closing body 10 of the refill valve 12 is released. The refill valve 12 opens as a consequence of the underpressure prevailing in the piston work chamber and permits hydraulic medium to flow from the supply container 11 into the piston work chamber. As a result, the diaphragm 4 and the support plate 7 move back in the direction of the supply chamber 3 again, under the pressure of the springs 8 and 8***a*. The control push rod 13 is held in engagement with the support plate 7 by the pressure of the spring 8 and accordingly executes the same movement. Over the course of this movement, the operating rod slides upward along the conical circumferential recess 13, until it is again supported by the outer periphery of the control push rod 13. As a result, the control push rod 13 is arrested in turn in the closed position of the valve.

The spring shown on the valve 12 serves solely to prevent the closing body 10 from dropping, but does not exert any significant closing force on the valve.

A piston diaphragm pump is thus created which advantageously eliminates the disadvantages discussed at the outset herein.

It is to understood that the foregoing text and drawing relate to an embodiment of the invention given by way of example by not limitation. Various other embodiments and variants are possible within the spirit and scope of the invention and the scope of the following claims.

What is claimed is:

1. A diaphragm plunger pump comprising a pump housing having a pumping chamber and a drive chamber adapted to be filled with hydraulic fluid, a diaphragm sealingly mounted in said pump housing and separating said drive chamber from said pumping chamber, a plunger guided in said drive chamber for reciprocating movement causing a pumping deflection of said diaphragm by displacement of hydraulic fluid in said drive chamber, a supply container for hydraulic fluid communicating with said drive chamber via a refill valve opening in flow direction away from the supply container, a displaceable diaphragm support plate disposed in said drive chamber for limiting the deflection of said diaphragm towards said drive chamber, a control member axially movable by said support plate between a blocking position keeping said refill valve closed, and a release position permitting said refill valve to open in response to a pressure difference between said supply container and said drive chamber, said support plate being freely displaceable in said drive chamber for limited axial and tilting movement, said control member comprising a separate push rod independently guided in said pump housing for limited axial movement between a blocking position at which said push rod may abut a radially outer portion of said support plate and a release position at which said push rod rests against said support plate; spring means biasing against said push rod into said blocking position, and said support plate being displaceable by said diaphragm to rest with a radially outer portion thereof against said push rod for displacing said push rod against the bias force of said spring means into its release position.

2. A diaphragm plunger pump as defined in claim 1, wherein said support plate is formed with an outer edge annular bead having a rounded outer surface.

3. A diaphragm plunger pump as defined in claim 1, wherein there is provided a plurality of springs spaced around the periphery of said support plate for resilient abutment with radially outer portions of said support plate.

4. A diaphragm plunger pump as defined in claim 1, wherein between said refill valve and said push rod there is guided a displaceable locking member which in the blocking position of said push rod mechanically arrests said refill valve and in the release position of said push rod is displaceable to permit opening of said refill valve.

5. A diaphragm plunger pump as difined in claim 1, wherein said separate push rod has a conical circumferential recess which in said release position permits opening of said refill valve.

* * * * *